US005133544A

United States Patent [19]

Patik

[11] Patent Number: 5,133,544

[45] Date of Patent: Jul. 28, 1992

[54] METHOD AND APPARATUS FOR THERAPEUTIC EXERCISE

[76] Inventor: Robert M. Patik, 823 Reservoir St., Mount Pleasant, Pa. 15666

[21] Appl. No.: 462,103

[22] Filed: Jan. 8, 1990

Related U.S. Application Data

[63] Continuation-in-part of Ser. No. 377,258, Jul. 10, 1989, Pat. No. 5,011,155, which is a continuation-in-part of Ser. No. 199,862, May 25, 1988, abandoned.

[51] Int. Cl.[5] ..... A63B 21/00

[52] U.S. Cl. ..... 482/49; 128/77

[58] Field of Search ..... 272/67, 68, 135, 141; 128/77; 84/465, 467

[56] References Cited

U.S. PATENT DOCUMENTS

| | | | |
|---|---|---|---|
| 3,378,948 | 4/1968 | Gervaise | 446/81 |
| 3,612,521 | 10/1971 | Wendeborn | 272/67 |
| 4,103,682 | 8/1978 | Franzl | 128/77 X |
| 4,227,342 | 10/1980 | Knowles | 272/67 X |
| 4,356,579 | 11/1982 | Bond | 5/431 |
| 4,706,658 | 11/1987 | Cronin | 128/77 |
| 4,730,827 | 3/1988 | Williams | 272/68 |
| 4,750,734 | 6/1988 | Greenfield | 272/135 X |
| 4,828,249 | 5/1989 | Keating | 272/141 X |
| 4,832,007 | 5/1989 | Davis | 128/70 |
| 5,013,030 | 5/1991 | Frins | 272/67 |
| 5,020,524 | 6/1991 | Donohue | 128/77 X |

*Primary Examiner*—Randall L. Green

*Assistant Examiner*—David H. Willse

*Attorney, Agent, or Firm*—Lawrence R. Burns

[57] ABSTRACT

Disclosed is a method and apparatus for therapeutic exercise of the muscles and tendons of the group that give strength and movement to the hands and fingers. The apparatus comprises a body of pliable elastic material having finger holes formed therein so as to have an interference fit with fingers inserted into the body. The finger holes are dimensioned so that the periphery of the holes will cover substantially the entire length of the fingers, if not parts of the backhand and palm. Portions of the holes are located so as to come into contact with the distal end of the fingers when the fingers are moved or curled during movement. The method comprises the steps of inserting the fingers into the holes and moving the fingers and hands against the elasticity of the body of material. The movements may be by the fingers themselves or the opposing movements of both hands. The material used for the body may be soaked with a warm fluid so as to add heat to the hands and fingers during movement or non movement while positioned in the body of material. The invention further comprises the steps of manufacture of the body of material itself which comprises the steps of selecting the material from a polyurethane foam material and forming the holes therein to fit closely over the fingers and extend so as to contact the distal ends of the fingers when inserted into the material.

10 Claims, 1 Drawing Sheet

METHOD AND APPARATUS FOR THERAPEUTIC EXERCISE

RELATED APPLICATIONS

This application is a continuation-in-part application of co-pending application Ser. No. 07/377,258, filed Jul. 10, 1989, entitled THERAPEUTIC HAND EXERCISER, now U.S. Pat. No. 5,011,135, which was a continuation-in-part application of the then co-pending application Ser. No. 07/199,862, filed May 25, 1988 and entitled THERAPEUTIC EXERCISER, now abandoned.

BACKGROUND OF THE INVENTION

This invention relates to physical therapy and more particularly to the rehabilitation of the group of muscles that co-ordinate and give strength to the movement of the forearms, hands and fingers. The methods and device of this invention are for use in medical therapy, preferably after training by a therapist.

The human musco-skeletal arrangement with its connective tissues and tendons on many occasions is benefited by a regular program of exercise. Broken bones usually require that the affected site be immobilized until the fracture has united, after which muscle atrophy and joint stiffness will be found. Physiotherapy is of great help in the mobilization of the stiffened limb, but active movements and active muscle contractions by the patient are usually the ultimate key to success.

In addition the connective tissue between the muscle and bones are subject to numerous type diseases that may ultimately destroy the usefulness and movement of the appendages, and in particular the appendages of the fingers and hands. Such diseases are typically identified as an arthritis, and are used to describe the conditions arising from involvement of the joints and their immediate surrounding structures by disease. The most usual symptoms of the diseases are the stiffness and aching that accompany the movement of any affected joint. In some cases rest for the individually involved joint is necessary, and in some cases it is best for the joint to be kept as straight as possible, not flexed or bent. To such ends resting splints have been devised particularly for the fingers, hands, and wrists to be worn at night. Rest of the affected joint does not mean immobilization. In order to prevent loss of muscle power and to avoid crippling joint deformity, rest must be accomplished by an active, prescribed exercise program. Such programs once demonstrated to the patient may then be carried on in a home environment. For a patient with a degenerative arthritis condition, physiotherapy, local heat, massages, and supervised exercise enable a patient to carry on for many months in moderate comfort.

Where prescribed by a medical therapist, the application of heat is one of the most effective measures for temporary relief of aches and pains of affected muscle and connective joints and also aids muscles to relax, making exercises more effective. Heat therapy is of several types—dry heat, wet heat, and use of counter irritants (as recommended). Dry heat may be applied by filament lamps, bakers, hot water bottles, electric pads or paraffin baths. Wet heat is applied by hot water, hot fomentations, and contrast baths. Counter irritants usually consist of various liniments and ointments containing irritant substances which, when applied to the skin, cause a reflex dilation of blood vessels, producing a local feeling of warmth.

Other diseases that are seemingly helped by exercises are Charco Marie Tooth, Scleroderma and Sclerosis, particularly where they affect the hands.

Prior art devices especially used for the exercise of the hands are described in U.S. Pat. No. 4,730,827 granted to Williams and Great Britain patent 206,592 dated 12-86 to Gree. The patents generally disclose the prior art devices to be ball-like in nature and usually made from a rubber material or other mechanical arrangement that is compressible in one direction as they are gripped by the hand. Gree specifically points out that "there is generally no provision for accommodating with a single hand exerciser all of the movements associated with the parts of the anatomy in question. It is a universally acknowledged fact in physiotherapy that neuromuscular progress is dependent on the ability to stimulate muscles from different angles with use of different exercises and training principles."

The devices shown in the above described patents seem to contact the fingers in a line or point contact mode and do not provide an overall or continuous environment of resistance against which the fingers, hands and other co-ordinating muscles may work in an efficient manner.

BRIEF SUMMARY OF THE INVENTION

According to the present invention there is disclosed a therapeutic hand exerciser which comprises a preferably elongate body of pliable elastic material, preferably made from a polyurethane foam material. The body has two opposing ends that are preferably opposite, and preferably substantially parallel, to one another with at least one finger hole in each opposing end that extends toward the other opposing end.

Preferably there will be at least five holes through each opposing end of the body with each hole extending to cover substantially the length of the finger inserted therein and will extend beyond the distal end of the finger. The finger holes will be sized so as to closely surround the periphery of the finger and preferably will form an interference fit with each finger when it is inserted in its respective hole. It is contemplated that each opposing end will have five holes, that being for four fingers and one thumb (thumb will henceforth be referred to as finger for purposes of this discussion unless otherwise indicated).

The body of elastic material is preferably made in a cylindrical configuration with substantially parallel opposing end faces. The finger holes that are formed through each end face are preferably formed by passing a drill like tool from the front of one end face completely through both faces of the body at one time so that the holes on one end face extend continuously through the elastic body. When the elastic body is of a cylindrical configuration the finger holes may be formed so that their centerlines are substantially parallel with, or form a small included angle with, the centerline of the cylindrical body. In another configuration it may be preferable to form the centerlines of one set of holes so that they form an acute included angle with the centerline of the cylindrical body. With the centerlines forming an acute included angle with the centerline of the body of elastic material it is also possible to form the opposing end hole centerlines so that they are substantially parallel with one another, or so that their centerlines intersect within the body of elastic material. Another form of finger hole that may be desirable is to form the finger holes in the elastic body so that the centerline of some of the holes are curved from beginning to end.

The material of the body should be formed of a hand pliable elastic material and the preferred form is of a polyurethane, preferably a polyurethane foam material. The outer skin of the body of material may be formed of a denser material that is tough, wear resistant, tear proof, and hand washable so as to keep a nice appearance during the life of the exerciser.

While the preferable mode for the elastic body may be a cylindrical body the invention may also take the form of a ball of elastic material having opposing surfaces for finger holes. In either event it is also preferred that the opposing faces or ends with the finger holes in them have portions on them for contacting the palms of the hands when the fingers are squeezed together in the finger holes. The holes and the palm contact portions are sized and spaced so that as the hands and fingers squeeze a continuously distributed increasing load of resistance is met as the fingers move further from their original rest positions. The holes alone are designed so that the movement of the fingers from their original rest position will create an increasing distributed load along the length of the finger whether it is contracted or expanded from its original rest position.

According to the present invention there is also contemplated the method of therapeutic exercise which comprises the steps of forming finger-tight holes in opposing ends of a body of pliable elastic material so that the finger holes substantially cover the length of the fingers and extend beyond the distal end of the fingers when they are inserted in the finger holes. Using both the left and right hands the fingers of each hand are then inserted into the holes for substantially their entire length. The fingers are then moved in the holes against the resistance of the elastic body in almost any manner prescribed or desired. The preferred mode or movement is for the fingers to be expanded to a full open position and then contracted towards a closed position, with this step being repeated in a rather rapid fashion. Another method of movement for the fingers is for the distal ends of the fingers to be moved so that the ends trace a circle of 360 degrees while being held in a straight out position.

While the fingers are moved or moving the hands may also be moved so as to provide exercise for the forearms, arms and upper body parts. The movement of the hands preferably may take the form of rotating one hand in relation to the other, either by keeping one hand still and moving the other or by moving both hands at the same time. Usually, and the preferred mode, will be for the patient to be grasping the elastic material with the fingers squeezing on the body of material and then moving the hands so as to oppose each others movement and provide resistance to the movement. Rather than rotation it may be preferred by the patient to pull the hands in an opposite direction while the fingers are secured in the finger holes, or to both pull and rotate the hands while the elastic body is in the hand held position.

The invention further contemplates the step of heating the hands and/or the fingers during exercise because heating has a great therapeutic effect. The heating step may comprise soaking the elastic material surrounding the fingers with a heated fluid such as water. The heating step may also comprise surrounding the fingers with a hot wax material while the fingers are inserted in the finger holes of the elastic material. The heating step may also comprise placing counterirritants in the finger holes prior to insertion of the fingers in the elastic body.

According to the present invention there is also contemplated the method of making a therapeutic exerciser which comprises the steps of selecting an elastic material that is hand pliable and then forming a body of said elastic material having opposing end faces. Close fitting finger insertion holes are then formed in each of the opposing end faces of the elastic material with the holes sized so as to closely surround and extend substantially the length of, and beyond the distal end of, each finger when the fingers are inserted in the finger holes.

The step of selecting the elastic material includes the step of selecting a polyurethane, and preferably a polyurethane foam, material. Preferably the method will also comprise forming the material so that it has a dense outer skin on it that is wear resistant, tough, and hand washable, while the elastic material will form the core of the elastic body.

A further step of the method of manufacture will preferably be to configure the body in a cylindrical configuration having opposing ends and preferably substantially parallel opposing ends. Although the elastic body may also be formed in the configuration of a ball with sufficient diameter to form the finger holes as previously specified. Preferably the centerlines of the holes will be straight and the corresponding centerlines of the corresponding holes in each opposing face will be congruent with one another. When this is done the finger holes may then be formed by passing a hole forming tool from one opposing face through the other opposing face, so as to form a continuous hole completely through the body of elastic material. When the elastic body is configured so as to be in the configuration of a cylinder it may be preferable to form the centerline of the finger holes substantially parallel with the centerline of the cylindrical body.

The method of manufacture also contemplates making the elastic body out of composite parts. According to the present invention the elastic body may be formed by the steps of forming a left hand section with finger holes therein, forming a right hand section with finger holes therein, and bonding the two sections together. The method of making a therapeutic exerciser may alternately include the steps of forming a left hand section with finger holes therein, forming a right hand section with finger holes therein, and forming a center section so that the left and right hand sections may be bonded to the center section, and bonding the left and right hand sections to the center section.

The steps of forming the location of the centerlines of the holes also contemplates the step of forming the centerlines of the finger holes so that they form an acute included angle with the centerline of the cylindrical body within the elastic material. Alternately, the invention contemplates the step of forming the centerlines of the set of finger holes of the left hand side so that they are substantially parallel to the set of centerlines of the finger holes on the right hand side. Instead of forming the finger holes with a straight centerline the invention also contemplates the step of forming the centerline of some of the finger holes so that they are curved from beginning to end.

OBJECTS OF THE INVENTION

It is an object of the present invention to provide a therapeutic hand exerciser that will provide therapeutic value to the group of muscles and tendons that control the strength and movement of the fingers and hands.

It is an object of the present invention to provide a therapeutic exerciser that provides a variety of resistances to the movements of the fingers and hands during their movement.

It is an object of the present invention to provide an affordable exerciser for an individual to exercise his fingers, hands, arms chest, shoulders, and upper body muscles in unison with individual arm and finger movements.

It is an object of the present invention to provide a hand held exerciser unit that allows measured resistance against exercising movement for the fingers and hands in almost any direction.

It is an object of the present invention to provide a hand exerciser to provide for both hands to exercise at the same time on the same exerciser.

It is a further object of the present invention to provide a hand exerciser that may easily be used with the application of heat during the exercise period.

It is a further object of the present invention to provide a durable and lightweight hand exerciser that permits a full range of motions for the hands.

DETAILED DESCRIPTION OF THE INVENTION

Figure 1:
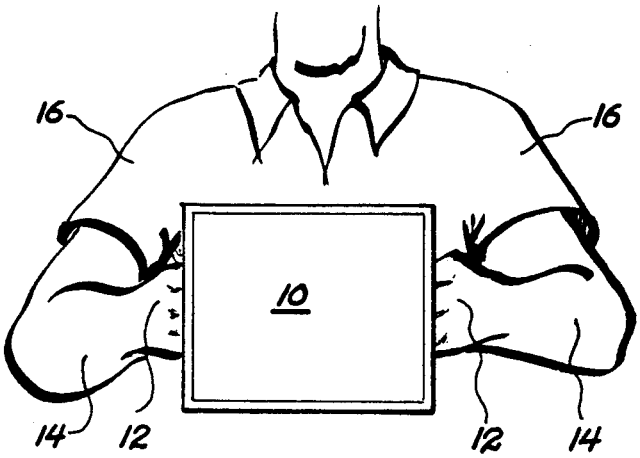
FIG. 1 is a front view of a patient using a hand exerciser according to the present invention.

What is shown in FIG. 1 is a patient 5 holding a hand exerciser 10 according to the present invention. The patient 5 has his hands 12 engaged with the exerciser 10 and is capable of movement of the forearms 14 the upper arms 16 and the upper body torso 18.

Figure 2:
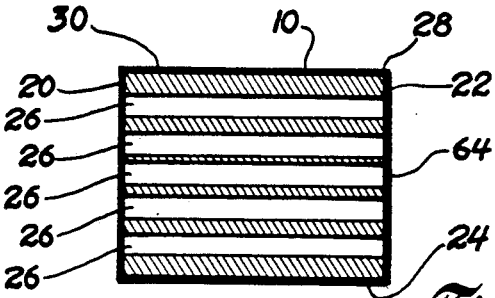
FIG. 2 is a partially cut - away front view of a hand exerciser according to the present invention.

What is shown in FIG. 2 is the hand exerciser 10 shown having opposing ends 20 and 22 and an intermediate section 24. Finger holes 26 are shown extending from one opposing end 20 thru the other opposing end 22 in the exerciser 10. The exerciser 10 has a body of material 28 that is preferably formed of a pliable elastic material most preferably in the form of a polyurethane foam material. The polyurethane foam material forming the body 28 may be surrounded by a dense outer layer 30 that forms a more wear resistant hand washable decorative outer covering.

Figure 3:
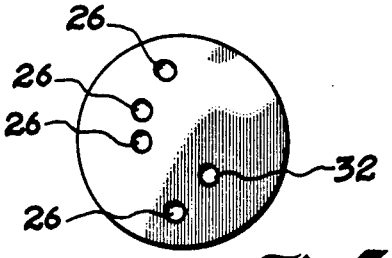
FIG. 3 is an end view of a hand exerciser according to the present invention.

What is shown in FIG. 3 is the opposing end face 22 having the finger holes 26 formed through the face 22 in a pattern to fit the fingers and thumbs of the patient 5. Note: in FIG. 3 the hole designated as 32 may be called a thumb hole whereas in reality it will be similar to the holes 26 already shown. Shown in FIG. 3 also is a preferred configuration of the body of material 28, a cylindrical configuration.

Figure 4:
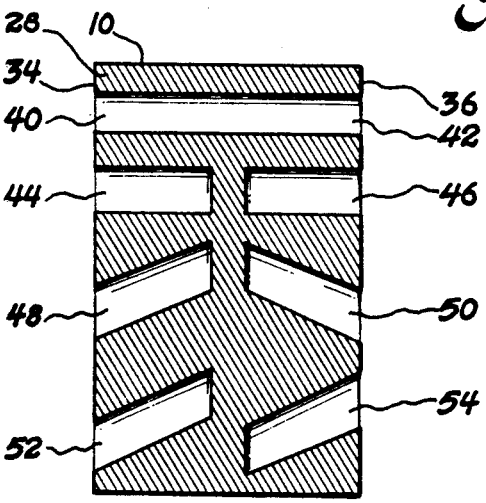
FIG. 4 is an exaggerated partially cut away front view of a hand exerciser according to the present invention.

Shown in FIG. 4 is a compressed version of the hand exerciser 10 according to the present invention. The body of material 28 has the cylindrical configuration as is shown in FIG. 3, and the opposing ends 34 and 36 of body 28 are substantially parallel to one another. Representative of the type of finger holes that may be placed in the body 28 is the finger hole shown in 38 which is continuous throughout the body 28 and which has and forms finger holes 40 and 42 on the opposing faces 34 and 36 respectively. In the case of the finger holes 40 and 42 the center lines of those holes are coincidental to each other and parallel to the center line of the cylindrical body 28. Shown beneath hole 38 are additional holes 44 and 46 formed on opposing faces 34 and 36 respectively. The center line of these holes may be again be coincidental and both of the center lines are again parallel to the center line of the cylindrical body 28. Figure holes 48 and 50 are shown formed so that their center lines form an acute included angle with the center line of the cylindrical body 28 although their respective center lines diverge as they extend outwardly from the vertical center line of cylindrical body 28. Finger holes 52 and 54 formed in and opposing surfaces 34 and 36 of cylindrical body 28 have center lines that are formed parallel to one another and yet still have a small included angle with the theoretical center line of the cylindrical body 28. It is intended that the any or all of the combinations of finger holes described above may be placed in the hand exerciser 10 according to the present invention.

Figure 5:
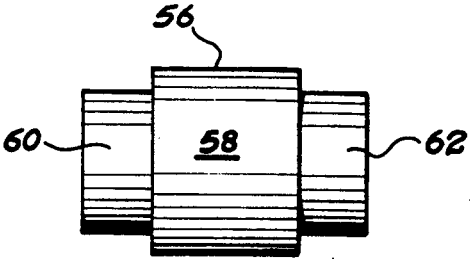
FIG. 5 is an alternate construction of a hand exerciser according to the present invention.

Shown in FIG. 5 is an alternate hand exerciser 56 shown having an intermediate section 58 joined on opposing sides by sections 60 and 62. It is contemplated that the manufacturer of the hand exerciser units 56 may be formed with the respective finger holes in sections 60 and 62 and then the sections 60 and 62 bonded to the intermediate section 58. Sections 60 and 62 may be of different densities to form different resistances.

In FIGS. 1 thru 5 it is intended that the finger holes be sized so that they have a close fitting relationship with patient 5's fingers, and preferably the diameter of the finger holes will form an interference fit with the diameter of the fingers. The length of the individual finger holes on the opposing faces 20 and 22, 34 and 36 should be sized so that substantially the entire length of the patient 5's fingers will fit into the holes while leaving room for the hole to extend beyond the distal end of the patient's fingers.

When the patient uses the hand exerciser 10, as is shown in FIG. 1, one of the exercises according to the present invention is for one of the patient's hands and fingers to close around the pliable elastic material forming the body 28. When this occurs a part of the body 28, shown at 64 in FIGS. 2 and 3, will bulge outwardly and contact the palm portion of the hand 12 of patient 5. It is a preferred mode that these palm contact portions 64 will be found on all opposing faces of the hand exercise units according to the present invention. The method of use contemplated in the present invention by the patient 5, as shown in FIG. 1, is for one of the patient's hands to rotate in one of the directions around the horizontal center line of the cylindrical body 28, while the other hand remains stationary or the other hand rotates in an opposite direction from the first hand. This motion may alternate in order to produce a vigorous exercise by the patient. In addition, the patient may want to pull the hands 12 apart while gripping the hand exerciser 10, or the patient may want to compress the hands 12 towards one another while the hands are placed in the finger holes of the hand exerciser 10. Additional movements by the hands may include bending the arms so that the horizontal center line of the cylindrical body 28 is bent from the straight line portion to diverging sections from the theoretical center line. The present invention also contemplates that the patient 5 may merely extend his fingers into the finger holes provided in the hand exerciser 10 and rotate any of his fingers so that the distal end of the finger traces a circle having a plane somewhat parallel to a vertical plane passing through the hand exerciser.

I claim:

1. The method of therapeutic exercise with a body of pliable elastic material having finger tight holes in opposing ends which comprises:

a. inserting the fingers of each hand into said holes until the inserted fingers are substantially covered by said body;

b. moving the fingers in said holes against the resistance of the elastic body.

2. The method of therapeutic exercise according to claim 1 which further comprises the step of heating the fingers while they are inserted in said elastic material.

3. The method of therapeutic exercise according to claim 2 in which the step of heating the fingers comprises the step of soaking the elastic material surrounding the fingers with a heated fluid.

4. The method of therapeutic exercise according to claim 2 in which the step of heating the fingers includes the step of surrounding the fingers with a hot wax material while inserted in the finger holes of the elastic material.

5. The method of therapeutic exercise according to claim 2 in which the step of heating the fingers comprises the step of placing counterirritants in the finger holes prior to insertion of the fingers in the elastic body.

6. The method of therapeutic exercise according to claim 1 which further includes the step of rotating one hand in relation to the other while said fingers are in said elastic body.

7. The method of therapeutic exercise according to claim 1 which further includes the step of partially rotating one hand in an opposite direction from the other hand while said fingers are inserted in said elastic body.

8. The method of therapeutic exercise according to claim 1 which further includes the steps of closing said fingers on said elastic body and rotating one hand in relation to the other while gripping said elastic body.

9. The method of therapeutic exercise according to claim 8 which further includes the step of pulling said hands in an opposite direction during said rotating movements.

10. The method of therapeutic exercise according to claim 1 which further includes the step of alternately expanding and contracting said fingers on each hand to a full open position and then towards a closed position, respectively.

* * * * *